US008342885B2

(12) United States Patent
Jetton

(10) Patent No.: US 8,342,885 B2
(45) Date of Patent: Jan. 1, 2013

(54) SERVICEABLE INLINE AC FUSE HOLDER

(75) Inventor: James Thomas Jetton, Ann Arbor, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 13/103,567

(22) Filed: May 9, 2011

(65) Prior Publication Data

US 2012/0289086 A1 Nov. 15, 2012

(51) Int. Cl.
*H01R 13/68* (2011.01)

(52) U.S. Cl. ..... 439/620.26; 439/830

(58) Field of Classification Search ..... 439/620.26, 439/620.28, 620.29, 830, 833; 337/188, 337/189, 205
See application file for complete search history.

(56) References Cited

U.S. PATENT DOCUMENTS

| | | | | |
|---|---|---|---|---|
| 1,601,673 | A | 9/1926 | Bridgman | |
| 3,356,806 | A | 12/1967 | Urani | |
| 3,843,050 | A | 10/1974 | Melugin | |
| 4,202,589 | A * | 5/1980 | Reavis et al. | 439/391 |
| 4,391,485 | A * | 7/1983 | Urani | 439/687 |
| 4,734,059 | A | 3/1988 | Melugin | |
| 4,909,761 | A | 3/1990 | Muguira | |
| 4,941,851 | A * | 7/1990 | Hsueh | 439/620.34 |
| 5,018,991 | A | 5/1991 | Katz et al. | |
| 5,267,880 | A | 12/1993 | Tamm | |
| 5,648,749 | A | 7/1997 | Lin et al. | |
| 5,772,473 | A | 6/1998 | Cheng et al. | |
| 5,888,098 | A | 3/1999 | Cheng et al. | |
| 6,932,639 | B2 | 8/2005 | Woodruff | |
| 7,377,813 | B2 | 5/2008 | Pentell et al. | |
| 7,407,416 | B1 * | 8/2008 | Rogers et al. | 439/669 |
| 7,416,453 | B2 * | 8/2008 | Germani | 439/752 |
| 2009/0309689 | A1 | 12/2009 | Pavlovic et al. | |
| 2010/0139733 | A1 | 6/2010 | Jonczyk et al. | |
| 2010/0164678 | A1 | 7/2010 | Pentell et al. | |

* cited by examiner

*Primary Examiner* — Thanh Tam Le
(74) *Attorney, Agent, or Firm* — Harness, Dickey & Pierce, P.L.C.

(57) ABSTRACT

An inline fuse holder for housing a fuse that electrically connects first and second wire terminals is provided. The inline fuse holder can generally include a cannulated fuse holder housing having a cylindrical inner periphery. The fuse holder housing can have a first end that defines a first opening, and a second end that defines a second opening. The first and second ends comprise first locking features. A first wire connector includes a connector housing that defines a through bore. The connector housing can have a boss configured to be received by the first opening of the fuse holder housing. The first wire connector further includes a second locking feature that is configured to selectively lock with one of the first locking features in the installed position.

18 Claims, 5 Drawing Sheets

SERVICEABLE INLINE AC FUSE HOLDER

FIELD

The present disclosure relates to fuses and more particularly to a serviceable, weathertight inline AC fuse holder.

BACKGROUND

This section provides background information related to the present disclosure which is not necessarily prior art.

In some examples, it may be desirable to apply an inline fuse to the AC wire harness of an electric automobile. In these examples, the fuse must be sealed from the elements and have provisions for mounting existing AC fuse assemblies are not intended for automotive use. As a result, they pose many shortcomings regarding sealing and packaging.

SUMMARY

This section provides a general summary of the disclosure, and is not a comprehensive disclosure of its full scope or all of its features.

An inline fuse holder for housing a fuse that electrically connects first and second wire terminals is provided. The inline fuse holder can generally include a cannulated fuse holder housing having a cylindrical inner periphery. The fuse holder housing can have a first end that defines a first opening, and a second end that defines a second opening. The first and second ends comprise first locking features. A first wire connector includes a connector housing that defines a through bore. The connector housing can have a boss configured to be received by the first opening of the fuse holder housing. The first wire connector further includes a second locking feature that is configured to selectively lock with one of the first locking features in the installed position. A seal member can be disposed around the boss and is configured to sealably connect the circular inner periphery of the fuse holder housing in the installed position. The wire terminal is configured to extend at least partially in the through bore and electrically mate with the fuse such that the fuse is maintained in a weathertight chamber within the fuse holder housing.

According to additional features, the first wire connector can further comprise a locking door having a third locking feature. The locking door can be configured to rotate between an open position wherein the wire terminal is selectively passed into the through bore and a closed position wherein the third locking feature is configured to selectively couple with a fourth locking feature formed on the connector housing. The wire terminal can include a collar that is selectively received into the connector housing. The collar can have a greater outer dimension than an opening formed through the locking door. The locking door can capture the collar within the connector housing in the closed position.

According to still other features, the third locking feature can comprise a pair of opposing locking tabs each having an opening therein. The fourth locking feature can comprise a pair of corresponding first tangs that are configured to locate at least partially into the respective openings of the locking tabs in the closed position. The first tangs can each include a first ramp that is configured to progressively deflect the locking tabs until the first tangs locate at least partially into the respective openings of the locking tabs in the closed position. The first locking features can comprise a pair of opposing locking ears each having an opening therein.

In some examples, the second locking features can comprise a pair of corresponding second tangs that are configured to locate at least partially into the respective openings of the locking ears in the installed position. The second tangs can each include a second ramp that is configured to progressively deflect the locking ears until the second tangs locate at least partially into the respective openings of the locking ears in the installed position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
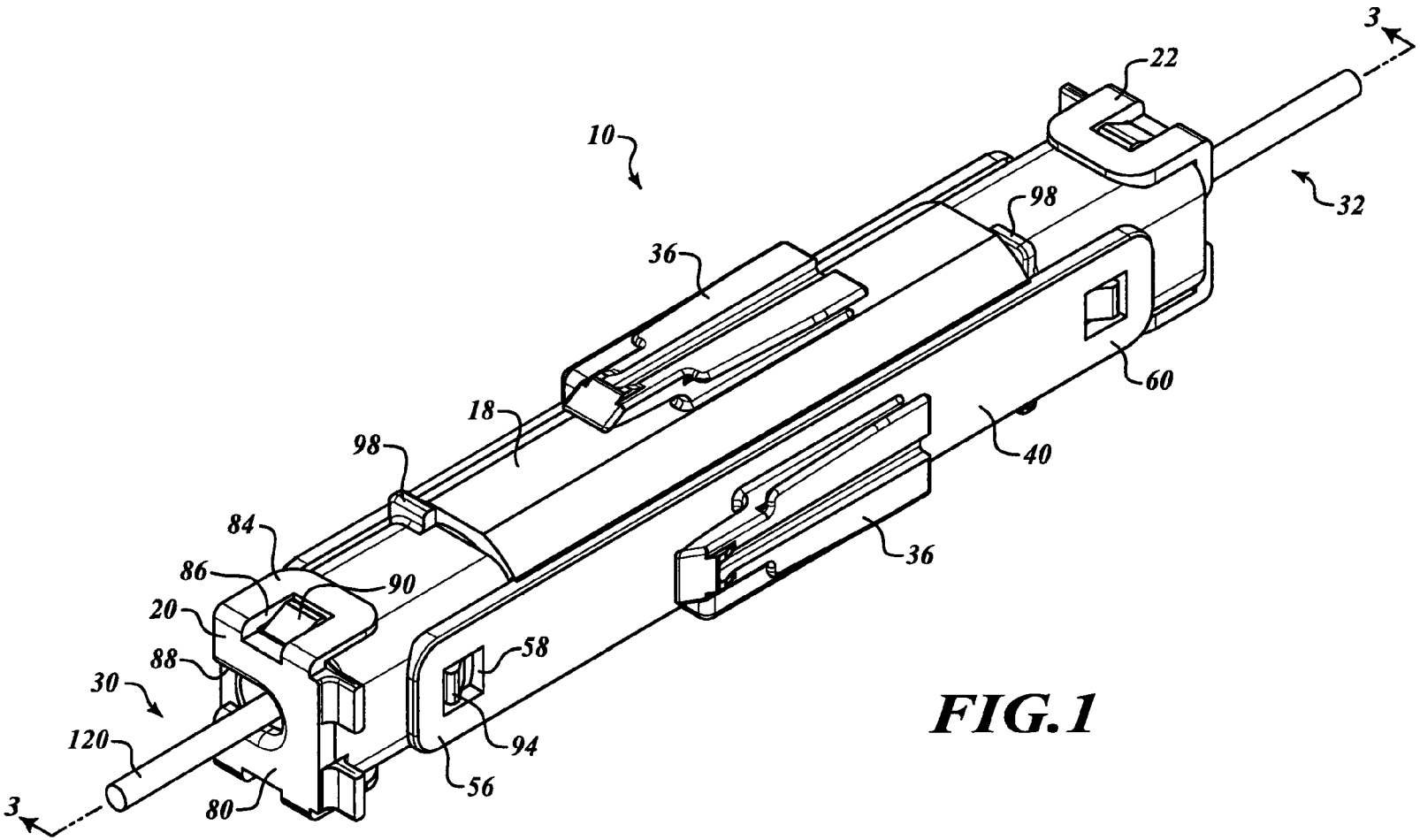
FIG. 1 is a perspective view of an inline fuse holder constructed in accordance to one example of the present teachings.
Figure 2:
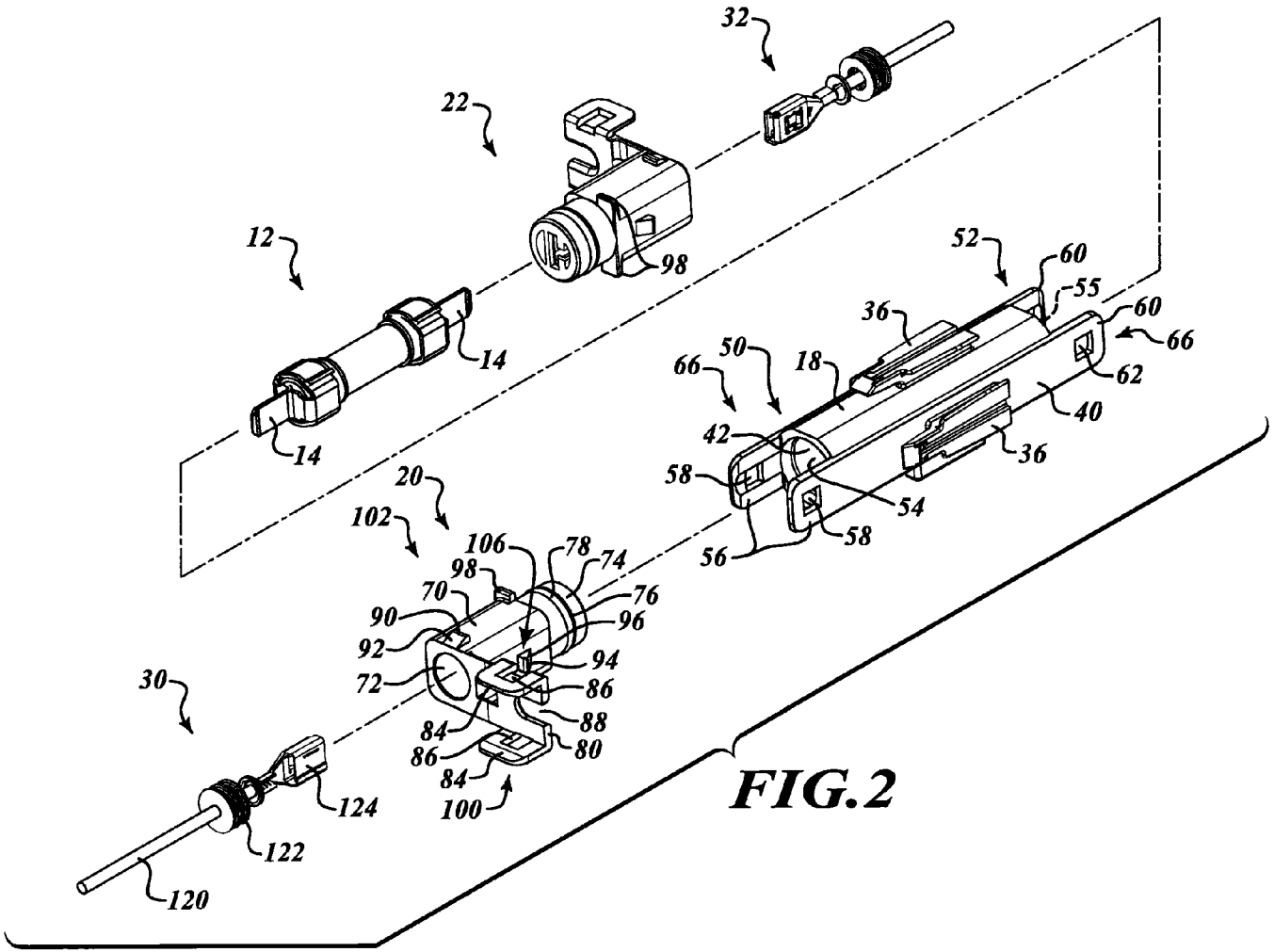
FIG. 2 is an exploded perspective view of the inline fuse holder shown in FIG. 1.

With initial reference to FIGS. 1 and 2, an inline fuse holder constructed in accordance to the present teachings is shown and generally identified at reference numeral 10. The inline fuse holder 10 is configured to hold an AC inline cylindrical fuse 12 with axial blade terminals 14 at each end. The inline fuse holder 10 has a fuse holder housing 18 that is generally cylindrical on an inner profile and accepts the fuse 12 in its center. The inline fuse holder 10 incorporates first and second wire connectors 20 and 22 on opposite ends. The first and second wire connectors 20 and 22 both selectively and releasably couple to the fuse holder housing 18 to provide a sealed, weathertight connection for wire assemblies 30 and 32. As will be described herein, the sealing is accomplished with a combination of captured wire seals and O-rings. The fuse holder housing 18 has attachment provisions or connectors 36 that allow it to connect to itself for multiple fuse applications as well as provisions for retainers (e.g. trees). As will become appreciate from the following discussion, the fuse holder housing 18 as well as the first and second wire connectors 20 and 22 are all serviceable by displacement of various locking features to gain access to and/or remove the fuse.

The fuse holder housing 18 is generally cannulated and can include a generally rectangular exterior periphery 40 and a cylindrical inner periphery 42. The cylindrical inner periphery 42 can be configured to slidably accept the fuse 12. The fuse holder housing 18 can generally include a first end 50 and a second end 52. The first end 50 can define a first opening 54 and the second end 52 can define a second opening 55. In one example, the first and second openings 54 and 55 can be collinear. The first end 50 can further comprise a pair of locking ears 56 that can extend generally parallel from each other. The locking ears 56 each define an opening 58 therein. Similarly, the second end 52 can include another pair of locking ears 60 that each have openings 62 formed therein. The locking ears 56 and 60 each provide first locking features 66 on the fuse holder housing 18. In one example, and as will be appreciated herein, the first locking features 66, and the fuse holder housing 18 as a whole can be formed of a rigid lightweight material that allows the locking ears 56 and 60 to first deflect generally outwardly, such as during coupling with the wire connectors 20 and 22, and subsequently return to an original position.

Figure 3:
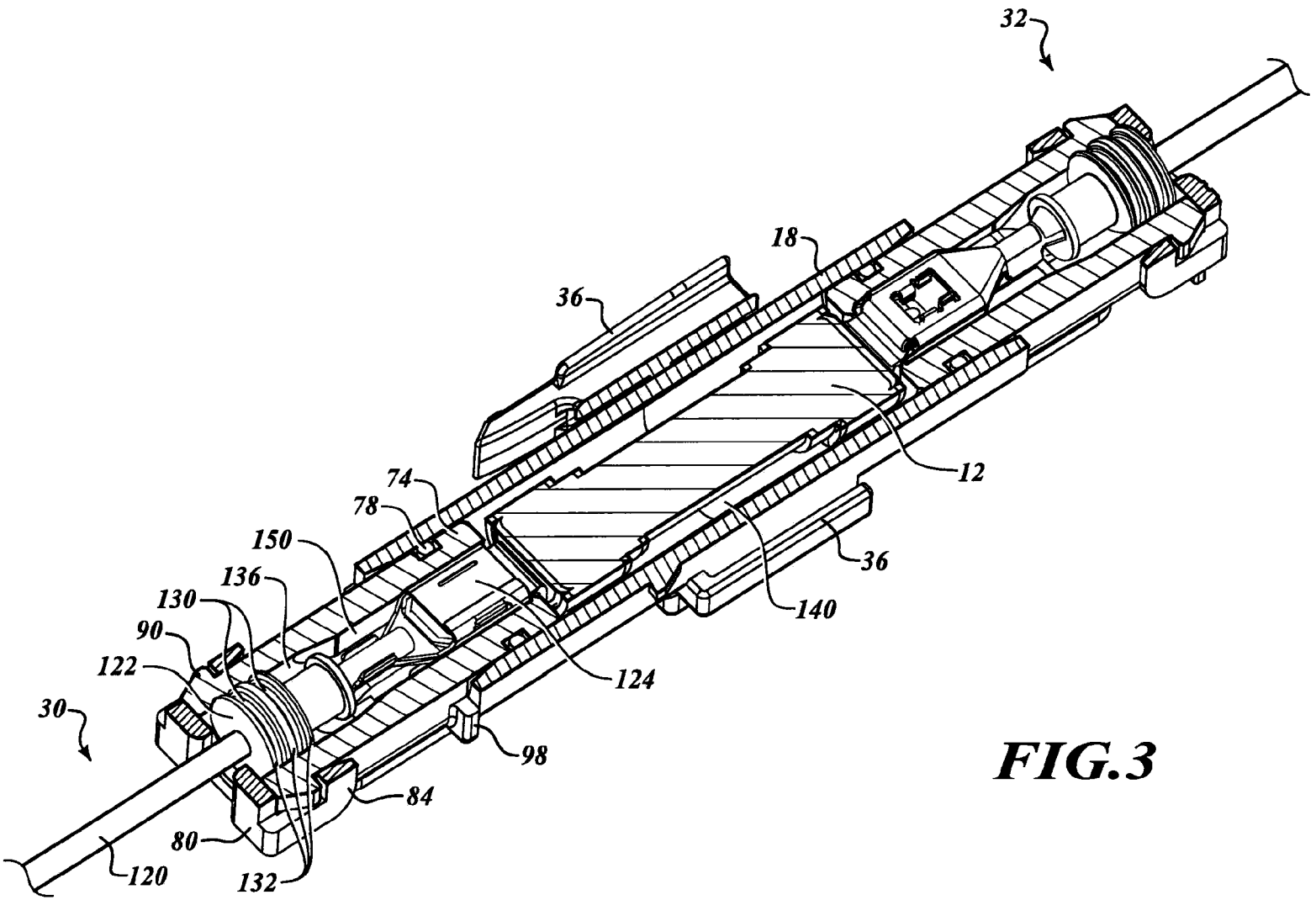
FIG. 3 is a cross-sectional view of the fuse holder taken along lines 3-3 of FIG. 1.

With reference now to FIGS. 2 and 3, the first wire connector 20 will be described in greater detail. As will become appreciated, the first and second wire connectors 20 and 22 are constructed similarly, therefore only specific description of the first wire connector 20 will be described with the understanding that similar features are also provided on the second wire connector 22. The first wire connector 20 generally comprises a connector housing 70 that defines a through bore 72 therein. The connector housing 70 can have a boss 74 extending therefrom. The configuration and geometry of the boss 74 is generally complementary to the circular inner periphery 42 of the fuse holder housing 18. The boss 74 can further comprise an annular recess 76 therearound. A sealing member such as an O-ring 78 can be disposed in the annular recess 76.

The connector housing 70 can further include a locking door 80 that is generally movably coupled to the connector housing 70 and movable between an open position (FIG. 2) and a closed position (FIG. 3). The locking door 80 can generally include a pair of opposing locking tabs 84 extending therefrom. The locking tabs 84 each generally define an opening 86 therein. A notch 88 can be provided on the locking door 80. A pair of first tangs 90 extend generally from the connector housing 70. The first pair of tangs 90 each include a ramp 92 thereon. The connector housing 70 also includes a pair of second tangs 94 that each include a ramp 96 thereon. A pair of locating arms 98 extend from the connector housing 70.

The locking tabs 84 can generally cooperate to provide a third locking feature 100. The first pair of tangs 90 can cooperate to provide a fourth locking feature 102. As will become appreciated, the third and fourth locking features 100 and 102 are configured to selectively and releasably lock. The connector housing 70 further includes a second locking feature 106 provided by the second pair of tangs 94. The second locking features 106 are configured to selectively and releasably connect with the first locking features 66 on the fuse holder housing 18.

Figure 4A:
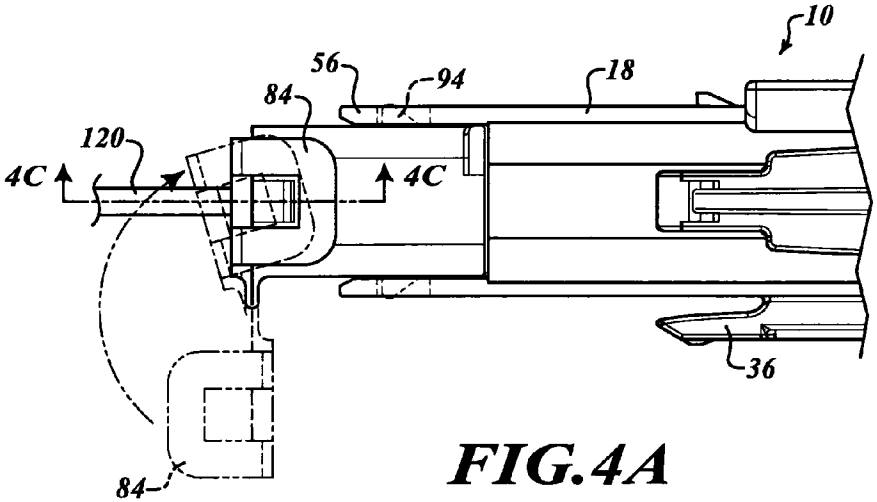
FIGS. 4A-4C illustrate a sequence of moving a locking door on a first wire connector from an open position (phantom line) to a closed position (solid line).
Figure 4C:
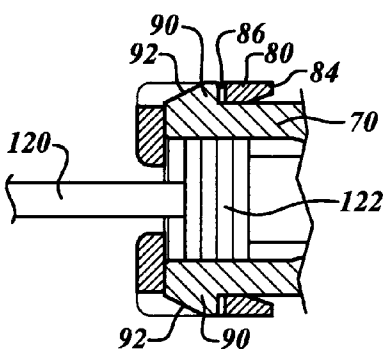
Figure 4B:
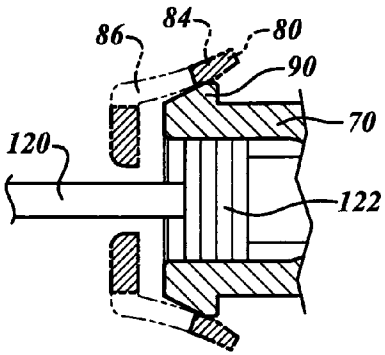

The locking door 80 is movable from an open position, as shown in FIG. 2, to a closed position as shown in FIG. 3. One example of moving the locking door 80 from the open position to the closed position will now be described with reference to FIGS. 4A-4C. In general, the locking door 80 can be rotated from the open position (phantom line, FIG. 4A) to the closed position (solid line, FIG. 4A). The locking door 80 can be rotated to a position such that the respective locking tabs 84 initially engage the first pair of tangs 90. Further advancement of the locking tabs 84 causes the locking tabs 84 to progressively deflect outward as a result of contacting the ramps 92 (FIG. 4B). Once the respective openings 86 have located to a position generally aligned with the tangs 90, the locating tabs 84 will retract to their original position such that the tangs 90 locate into the openings 86 in a locked position. The locking door 80 can also be moved from the closed position (FIG. 4C) to the open position (phantom line, FIG. 4A) by deflecting the locking tab 84 away from the first tangs 90 until the openings 86 generally clear the first tangs 90 and the locking door 80 can be rotated to the open position.

The wire assembly 30 will now be described in greater detail. It will be appreciated that the wire assembly 32 can be constructed similarly to the wire assembly 30, therefore only description of the wire assembly 30 will be described herein. The wire assembly 30 generally comprises a wire 120, a collar 122, and a wire terminal 124. The wire terminal 124 can be configured with a geometry that is configured to electrically mate with the blade terminal 14 on the fuse 12. The collar 122 generally comprises a pair of recesses 130 and a plurality of raised portions 132. The collar can be formed of resilient material. As can be appreciated, the geometry of the collar 122 will be provided such that it cooperates with the inner surface 136 provided on the through bore 72 of the connector housing 70. The collar 132 can partially compress to facilitate a seal. Such an interface can provide a weathertight seal. Similarly, the geometry of the O-ring 78 and boss 74 can be configured such that an interface between the O-ring 78 and the circular inner periphery 42 of the fuse holder housing 18 can also provide a weathertight seal.

Figure 5A:
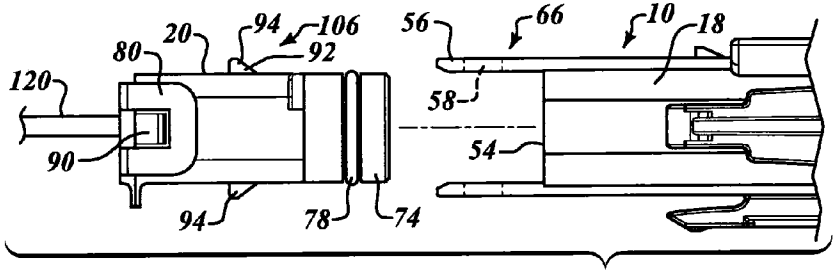
FIGS. 5A-5C illustrate an exemplary sequence of coupling the first wire connector to the fuse holder housing.
Figure 5B:
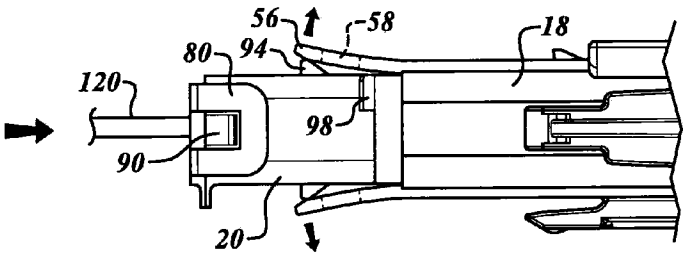
Figure 5C:
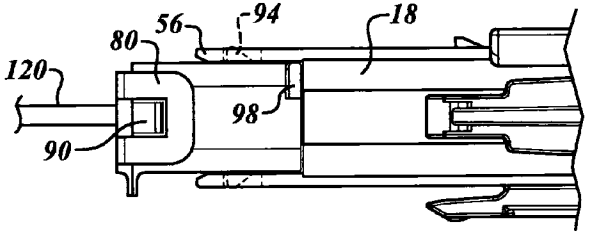

Turning now to FIGS. 5A-5C, an exemplary sequence of coupling the first wire connector 20 to the fuse holder housing 18 will be described. At the outset, the first wire connector 20 will be aligned such that the second locking features 106 are aligned for receipt by the first locking features 66 on the fuse holder housing 18. Next, the boss 74 can be generally inserted towards and into the first opening 54 on the fuse holder housing 18. Concurrently, the locating arms 98 can be aligned for slidably interfacing with an inner surface of the locking ears 56. Such action and alignment can provide the user tactile feedback that the first wire connector 20 is being correctly inserted into the first opening 54.

Once the second tangs 94 engage the locking ears 56, the respective ramps 92 will urge the locking ears 56 generally outwardly as shown in FIG. 5B. Continued advancement of the first wire connector 20 into the first opening 54 will cause the tangs 94 to locate into the openings 58 on the locking ears 56 (FIG. 5C). As can be appreciated, the first wire connector 20 can be withdrawn from the fuse holder housing 18 by deflecting the locking ears 56 outwardly to a position such that the second tangs 94 clear the openings 58 and the first wire connector 20 can be withdrawn from the first opening 54 in the fuse holder housing 18.

The configuration of the inline fuse holder 10 of the present teachings is particularly advantageous in that the fuse 12 can be easily serviceable while at the same time be provided in a weathertight chamber 140 (FIG. 3) that is defined in the fuse holder housing 18 generally between the opposing first and second wire assemblies 30 and 32. In this regard, if it is necessary to replace the fuse 12, a user or technician can simply deflect the first locking features 66 on the fuse holder housing away from the second locking features 106 on the connector housing 70 and thereafter withdraw the first wire connector 20 (and/or this can be done on the opposite end with the second wire connector 32). Similarly, if it is desired to only gain access to the wire terminal 124 on the wire assembly 30, a user or technician can simply rotate the locking door 80 from the closed position to the open position and withdraw the wire terminal 124 from connection to the blade terminal 14. Again, the connector housing 70 on the first wire connector 20 can also provide a weathertight chamber 150.

The fuse holder housing 18 can include the connectors 36. The connectors 36 can be in the form of slats or other geometries that can accept couplers such as Christmas trees that can allow for connection to other components. The connectors 36 can also take the form of bayonet style connectors that will permit the ganging up of multiple fuse holders in a row where appropriate.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An inline fuse holder for housing a fuse that electrically connects first and second wire terminals, the fuse holder comprising:

a cannulated fuse holder housing having a cylindrical inner periphery, the fuse holder housing having a first end that defines a first opening and a second end that defines a second opening, the first and second ends comprising first locking features;

a first wire connector having a connector housing defining a through bore, the connector housing having a boss configured to be received by the first opening of the fuse holder housing, the first wire connector further including a second locking feature that is configured to selectively lock with one of the first locking features in an installed position wherein the first wire connector further comprises a locking door having a third locking feature, the locking door configured to rotate between an open position wherein the wire terminal is selectively passed into the through bore and a closed position wherein the third locking feature is configured to selectively couple with a fourth locking feature formed on the connector housing; and a seal member disposed around the boss that is configured to sealably connect to the circular inner periphery of the fuse holder housing in the installed position;

wherein the first wire terminal is configured to extend at least partially in the through bore and electrically mate with the fuse such that the fuse is maintained in a weathertight chamber within the fuse holder housing.

2. The inline fuse holder of claim 1 wherein the wire terminal includes a resilient collar that is selectively received into the connector housing, the collar having a greater outer dimension than an inner dimension of the first wire connector such that the collar at least partially compresses and forms a weathertight seal with the connector housing, the locking door capturing the collar within the connector housing in the closed position.

3. The inline fuse holder of claim 1 wherein the third locking feature comprises a pair of opposing locking tabs each having an opening therein.

4. The inline fuse holder of claim 3 wherein the fourth locking feature comprises a pair of corresponding first tangs that are configured to locate at least partially into the respective openings of the locking tabs in the closed position.

5. The inline fuse holder of claim 4 wherein the first tangs each include a first ramp that is configured to progressively deflect the locking tabs until the first tangs locate at least partially into the respective openings of the locking tabs in the closed position.

6. The inline fuse holder of claim 1 wherein the first locking features comprises a pair of opposing locking ears each having an opening therein.

7. The inline fuse holder of claim 6 wherein the second locking feature comprises a pair of corresponding second tangs that are configured to locate at least partially into the respective openings of the locking ears in the installed position.

8. The inline fuse holder of claim 7 wherein the second tangs each include a second ramp that is configured to progressively deflect the locking ears until the second tangs locate at least partially into the respective openings of the locking ears in the installed position.

9. An inline fuse holder for housing a fuse that electrically connects first and second wire terminals, the fuse holder comprising:

a fuse holder housing having a first end that defines a first opening and a second end that defines a second opening, the first and second ends comprising first locking features;

a first wire connector having a connector housing defining a through bore, the connector housing having a boss configured to be received by the first opening of the fuse holder housing in an installed position, the first wire connector further including a second locking feature that is configured to selectively lock with one of the first locking features in the installed position, the first wire connector further comprising a locating arm extending therefrom that is configured to slidably advance along an inner surface of one of the first locking features and inhibit rotation of the first wire connector relative to the fuse holder housing in the installed position; and a seal member disposed around the boss that is configured to sealably connect to an inner periphery of the fuse holder housing in the installed position;

wherein the first wire terminal is configured to extend at least partially in the through bore and electrically mate with the fuse such that the fuse is maintained in a weathertight chamber within the fuse holder housing.

10. The inline fuse holder of claim 9 wherein the first wire connector further comprises a locking door having a third locking feature, the locking door configured to rotate between an open position wherein the wire terminal is selectively passed into the through bore and a closed position wherein the third locking feature is configured to selectively couple with a fourth locking feature formed on the connector housing.

11. The inline fuse holder of claim 10 wherein the wire terminal includes a resilient collar that is selectively received into the connector housing, the collar having a greater outer dimension than an inner dimension of the first wire connector such that the collar at least partially compresses and forms a weathertight seal with the connector housing, the locking door capturing the collar within the connector housing in the closed position.

12. The inline fuse holder of claim 10 wherein the third locking feature comprises a pair of opposing locking tabs each having an opening therein.

13. The inline fuse holder of claim 12 wherein the fourth locking feature comprises a pair of corresponding first tangs that are configured to locate at least partially into the respective openings of the locking tabs in the closed position.

14. The inline fuse holder of claim 13 wherein the first tangs each include a first ramp that is configured to progressively deflect the locking ears until the first tangs locate at least partially into the respective openings of the locking tabs in the closed position.

15. The inline fuse holder of claim 9 wherein the first locking features comprises a pair of opposing locking ears each having an opening therein.

16. The inline fuse holder of claim 15 wherein the second locking feature comprises a pair of corresponding second tangs that are configured to locate at least partially into the respective openings of the locking ears in the installed position.

17. The inline fuse holder of claim 16 wherein the second tangs each include a second ramp that is configured to progressively deflect the locking ears until the second tangs locate at least partially into the respective openings of the locking ears in the installed position.

18. An inline fuse holder for housing a fuse that electrically connects first and second wire terminals, the fuse holder comprising:

a cannulated fuse holder housing having a cylindrical inner periphery, the fuse holder housing having a first end that defines a first opening and a second end that defines a second opening, the first and second ends comprising first locking features;

a first wire connector having a connector housing defining a through bore, the connector housing having a boss configured to be received by the first opening of the fuse holder housing in an installed position, the first wire connector further including a second locking feature that is configured to selectively lock with one of the first locking features in the installed position, the first wire connector further comprising a locating arm extending therefrom that is configured to rotationally align and engage one of the first locking features wherein the first wire connector further comprises a locking door having a third locking feature, the locking door configured to rotate between an open position wherein the wire terminal is selectively passed into the through bore and a closed position wherein the third locking feature is configured to selectively couple with a fourth locking feature formed on the connector housing; and a seal member disposed around the boss that is configured to sealably connect to the circular inner periphery of the fuse holder housing in the installed position;

wherein the first wire terminal is configured to extend at least partially in the through bore and electrically mate with the fuse such that the fuse is maintained in a weathertight chamber within the fuse holder housing, wherein the wire terminal includes a resilient collar that is selectively received into the connector housing, the collar having a greater outer dimension than an inner dimension of the first wire connector such that the collar at least partially compresses and forms a weathertight seal with the connector housing.

* * * * *